United States Patent [19]

Fukui et al.

[11] Patent Number: 5,076,234

[45] Date of Patent: Dec. 31, 1991

[54] APPARATUS AND METHOD FOR CONTROLLING A MULTI-CYLINDER INTERNAL CONBUSTION ENGINE

[75] Inventors: Wataru Fukui; Toshio Iwata, both of Himeji, Japan

[73] Assignee: Mitsubishi Denki Kabushiki Kaisha, Tokyo, Japan

[21] Appl. No.: 605,308

[22] Filed: Oct. 30, 1990

[30] Foreign Application Priority Data

Oct. 30, 1989 [JP] Japan ..... 1-279929

[51] Int. Cl.[5] ..... F02P 5/00

[52] U.S. Cl. ..... 123/417; 123/416

[58] Field of Search ..... 123/417, 416; 364/431.03, 431.04, 431.05

[56] References Cited

U.S. PATENT DOCUMENTS

| | | | |
|---|---|---|---|
| 4,562,812 | 1/1986 | Chauvel | 123/417 |
| 4,597,373 | 7/1986 | Andreasson | 123/417 |
| 4,598,371 | 7/1986 | De Angelis et al. | 364/431.04 |
| 4,899,281 | 2/1990 | Grimaud et al. | 123/417 |

FOREIGN PATENT DOCUMENTS

| | | | |
|---|---|---|---|
| 5551 | 1/1982 | Japan | 123/417 |

*Primary Examiner*—Raymond A. Nelli

*Attorney, Agent, or Firm*—Sughrue, Mion, Zinn, Macpeak and Seas

[57] ABSTRACT

An engine control apparatus and method for accurately controlling the operation of an engine such as ignition, fuel injection, etc., particularly in the high-speed range or during a sudden change in the rotational speed of the engine. A signal generator generates a positional signal in the form of pulses representative of a reference piston position of each cylinder in synchrony with the rotation of the engine. A sensor means senses the operating conditions of the engine. A control unit in the form of a microcomputer, which includes a timer means for controlling the operations of the corresponding cylinders, calculates, based on the positional signal and the output signal of the sensor means, control times for controlling the corresponding cylinders at every reference piston position, and determine, at every reference piston position, whether the timer means has already done control on the cylinders. If the timer means has yet to do control on the cylinders, the control unit resets or updates the dimer means to new control times which are calculated at the present reference piston position for controlling the present operations of the cylinders. On the other hand, if the timer means has already done control on the cylinders, the control unit sets the timer means to new control times which are calculated at the present reference piston position for controlling the next operations of the cylinders.

5 Claims, 7 Drawing Sheets

FIRST INTERRUPT ROUTINE

SECOND INTERRUPT ROUTINE

APPARATUS AND METHOD FOR CONTROLLING A MULTI-CYLINDER INTERNAL CONBUSTION ENGINE

BACKGROUND OF THE INVENTION

The present invention relates to an engine control apparatus and method for accurately controlling the operation of the engine such as ignition, fuel injection, etc..

In order for a multi-cylinder internal combustion engine to properly operate, fuel injection, ignition and the like for each cylinder must take place at prescribed piston positions or rotational angles of the crankshaft of the engine, i.e., at the times when each piston of the engine is at prescribed positions with respect to top dead center.

FIG. 5 illustrates, in a block diagram, a conventional engine control apparatus for an internal combustion engine. The apparatus includes a signal generator 8 which generates a positional signal L in the form of pulses each indicating a corresponding cylinder, sensor means 20 including various kinds of sensors for sensing various engine operating conditions such as the engine load, the rotational speed, the engine temperature, etc., and generating an engine operation signal D indicative of the sensed engine operating conditions, an interface circuit 9, and a control means 10 in the form of a microcomputer which receives the positional signal L from the signal 8 and the engine operation signal D from the sensor means 20 through the interface circuit 9 and recognizes, based thereon, the operating condition (i.e., crank angle or rotational position) of each cylinder so that it can properly control the operating conditions such as ignition, fuel injection, etc., of the cylinders.

To this end, the microcomputer 10 includes a register means 11 for registering the positional signal L at every reference piston position of the cylinders in the form of a serial pattern, a fuel control means 13 such as a fuel injection control means for controlling the fuel supply to the respective cylinders, an ignition control means 14 for controlling the current supply to each ignition coil as well as ignition timings of the respective cylinders, a distributor control means 15 for controlling an unillustrated distributor, and a calculation and control means 12 for recognizing the operating piston position of each cylinder based on the positional signal L by making reference to the serial pattern registered in the register means 11, and controlling the fuel control means 13, the ignition control means 14 and the distributor control means 15.

FIG. 6 diagrammatically shows in more detail the construction of the calculation and control means 12. The calculation and control means 12 illustrated comprises a signal detection means 31 for detecting each reference piston position based on the positional signal L, a pulse period calculating means 32 for calculating the pulse period T of the positional signal L between the preceding two successive pulses at every reference piston position, a cylinder recognition means 33 for recognizing, based on a serial pattern P from the register means 11, to which cylinder a pulse of the positional signal L corresponds, a target control position calculation means 34 for calculating, based on the result of the cylinder recognition and the engine operation signal D, a target control position A for a cylinder at every reference piston position of the cylinder, a control time calculation means 35 for calculating, based on the pulse period T and the target control position A for the cylinder, a control time Tx for the cylinder, and a timer means 36 which is set to the control time Tx for controlling the control means 13 through 15 so as to properly control the cylinders. The timer means 36 includes a plurality of current-supply starting timers (not shown) each starting the current supply to a corresponding ignition coil for the ignition of a corresponding cylinder, and a plurality of current-supply cut-off timers (not shown) each cutting off the current-supply to a corresponding ignition coil so as to ignite a corresponding cylinder.

A typical example of the signal generator 8 is illustrated in FIG. 7. In this figure, the signal generator 8 illustrated includes a rotating plate 2 mounted on a rotating shaft 1 (such as the distributor shaft) which rotates in synchrony with the crankshaft of the engine. The rotating plate 2 has a set of first slits 3*a* formed therethrough at prescribed locations. The slits 3*a* are disposed at equal intervals in the circumferential direction of the rotating plate 2. The slits 3*a*, which are equal in number to the cylinders, are disposed so as to correspond to prescribed rotational angles of the crankshaft and thus to prescribed positions of each piston with respect to top dead center for sensing when the crankshaft reaches a prescribed rotational position for each cylinder. Another or second slit 3*b* is formed in the rotating plate 2 adjacent one of the first slits 3*a* at a location radially inwardly thereof for sensing when the crankshaft rotational angle is such that the piston of a specific reference cylinder is in a prescribed position.

A first and a second light emitting diode 4*a*, 4*b* are disposed on one side of the rotating plate 2 on a first outer circle and a second inner circle, respectively, on which the outer slits 3*a* and the inner slits 3*b* are respectively disposed. A first and a second light sensor 5*a*, 5*b* each in the form of a photodiode are disposed on the other side of the rotating plate 2 in alignment with the first and the second light emitting diode 4*a*, 4*b*, respectively. The first light sensor 5*a* generates an output signal each time one of the outer slits 3*a* passes between the first light sensor 5*a* and the first light emitting diode 4*a*. Also, the second light sensor 5*b* generates an output signal each time the inner slit 3*b* passes between the second light sensor 5*b* and the second light emitting diode 4*b*. As shown in FIG. 8, the outputs of the first and second light sensors 5*a*, 5*b* are input to the input terminals of corresponding amplifiers 6*a*, 6*b* each of which has its output terminal coupled to the base of a corresponding output transistor 7*a* or 7*b* which has the open collector coupled to the interface circuit 9 (FIG. 5) and the emitter grounded.

Now, the operation of the above-described conventional engine control apparatus as illustrated in FIGS. 5 through 9 will be described in detail with particular reference to FIG. 9 which illustrates the waveforms of the output signals of the first and second light sensors 5*a*, 5*b*.

As the engine is operated to run, the rotating shaft 1 operatively connected with the crankshaft (not shown) is rotated together with the rotating plate 2 fixedly mounted thereon so that the first and second light sensors 5*a*, 5*b* of the signal generator 8 generate a positional signal L which comprises a first and a second signal L1, L2 each in the form of a square pulse. The first signal L1 is a crank angle signal called SGT signal and has a rising edge corresponding to the leading edge of one of the outer slits 3*a* (i.e., a first prescribed crank angle or position of a corresponding piston) and a falling edge corresponding to the trailing edge thereof (i.e., a second prescribed crank angle of the corresponding piston). In the illustrated example, each square pulse of the SGT signal L1 rises at the crank angle of 75 degrees before top dead center (a first reference position B75 degrees) of each piston, and falls at the crank angle of 5 degrees before top dead center (a second reference position B5 degrees).

The second signal L2 is a cylinder recognition signal called SGC signal, and has a rising edge corresponding to the leading edge of the inner slit 3*b* and a falling edge corresponding to the trailing edge thereof. The SGC signal L2 is issued substantially simultaneously with the issuance of an SGT signal pulse corresponding to the specific reference cylinder #1 so as to identify the same. To this end, the inner slit 3*b* is designed such that it has a leading edge which corresponds to a crank angle before the first reference angle of the corresponding SGT signal pulse (i.e., a crank angle greater than 75 degrees before TDC), and a trailing edge corresponding to a crank angle after the second reference angle of the corresponding SGT signal pulse (i.e., a crank angle smaller than 5 degrees before TDC). Thus, actually, the rising edge of an SGC signal pulse occurs before that of a corresponding SGT signal pulse, and the falling edge of the SGC signal pulse occurs after that of the corresponding SGT signal pulse, so the SGC signal has a high level at the reference piston positions of 75 and 5 degrees BTDC.

The two kinds of first and second signals L1, L2 thus obtained are input via the interface circuit 9 to the calculation and control means 12 of the microcomputer 10 which recognizes, based on these signals, the specific reference cylinder #1 and the operational piston positions (i.e., crank angles or rotational positions) of the remaining cylinders #2 through #4, whereby various engine operations such as ignition timings, fuel injection timings, etc., are properly controlled.

Specifically, the signal detection means 31 of the calculation and control means 12 detects the positional signal L comprising the SGT signal L1 and the SGC signal L2 and generates a serial pattern P which takes the high or low level (i.e., 1 or 0) of the SGC signal L2 at the respective reference piston positions (i.e., 75 and 5 degrees BTDC) of the SGT signal L1. The serial pattern P thus formed is registered into the register means 11. The pulse period calculation means 32 calculates the pulse period T of the SGT signal L1 between prescribed reference piston positions. The cylinder recognition means 33 recognizes, based on the serial pattern P stored in the register means 11, the operating position of a piston in each cylinder, and outputs the result of such cylinder recognition to the target control position calculation means 34 which also receives the engine operation signal D from the sensor means 20 through the interface circuit 9.

The target control position calculation means 34 calculates, based on the result of the cylinder recognition and the engine operation signal D, an optimal target control position A such as an optimal ignition timing, an optimal fuel injection timing, etc., for a cylinder corresponding to the present pulse of the SGT signal L1, and outputs the thus obtained target control position A to the control time calculation means 35 which also receives the pulse period T from the pulse period calculation means 32.

The control time calculation means 35 calculates, based on the pulse period T and the target control position A for the cylinder, an appropriate control time Tx for the cylinder and accordingly sets the timer means 36. For example, in order to control the current-supply starting timing and the current-supply cut-off or ignition timing for a cylinder, a corresponding current-supply starting timer of the timer means 36 is set to a current-supply starting time Tsx (x=1 through 4 for cylinders #1 through #4), and a corresponding current-supply cut-off timer of the timer means 36 is also set to a current-supply cut-off or ignition time Tox (x=1 through 4 for cylinders #1 through #4), so that they control the fuel control means 13, the ignition control means 14 and the distributor control means 15 at the respective points in time thus set so as to distribute optimal control signals to the cylinder.

However, the current-supply starting time Tsx and the current-supply cut-off time Tox for a cylinder are set at each first reference piston position and at each second reference piston position, respectively, of a corresponding cylinder, and they, once set, are not updated until the following first or second reference piston position for the corresponding cylinder comes. As a result, in the event that the pulse period T of the SGT signal L1 sharply varies due to a sudden change in the number of revolutions per minute of the engine, control accuracy is considerably reduced for cylinders for which the control means 13 through 15 have to wait relatively extended periods of time until they begin to operate at set points in time. In particular, at high rotational speeds of the engine, a current supply period between a current-supply starting time and a current-supply cut-off time for a cylinder becomes longer relative to the pulse period T of the SGT signal L1 than at low speeds, so with a multi-cylinder engine having many cylinders, the control times for the respective cylinders may overlap, thus making the above control operations much more difficult and complicated. This necessarily results in a critical problem of substantial reduction in control accuracy.

SUMMARY OF THE INVENTION

Accordingly, the present invention is intended to obviate the above-mentioned problems of the conventional engine control apparatus, and has for its object the provision of an improved engine control apparatus and method for a multi-cylinder internal combustion engine which can improve the accuracy in controlling the operation of the engine to a practical extent.

In order to achieve the above object, according to one aspect of the present invention, there is provided an engine control apparatus for controlling the operation of an internal combustion engine which has a plurality of cylinders.

The apparatus comprises:

a signal generator for generating a positional signal in the form of pulses representative of a reference piston position of each cylinder in synchrony with the rotation of the engine;

sensor means for sensing the operating conditions of the engine and generating an output signal representative of the sensed engine operating conditions; and control means including timer means for controlling the operations of the cylinders, the control means being operable to calculate, based on the positional signal and the output signal of the sensor means, control times for controlling the corresponding cylinders at every reference piston position, and determine, at every reference piston position, whether the timer means has already done control on the cylinders, the control means further operating such that the timer means is reset to new control times which are calculated at the present reference piston position for controlling the present operations of cylinders if the timer means has yet to do control on the cylinders, whereas the timer means is set to new control times which are calculated at the present reference piston position for controlling the next operations of cylinders if the timer means has already done control on the cylinders.

Preferably, the control means comprises:

detection means for detecting each reference piston position based on the positional signal;

pulse period calculating means for calculating the pulse period of the positional signal between the preceding two successive pulses at every reference piston position;

cylinder recognition means for recognizing, based on the output of the detection means, to which cylinder a pulse of the positional signal corresponds;

target control position calculation means for calculating, based on the result of the cylinder recognition and the output signal of the sensor means, a target control position for each cylinder;

control time calculation means for calculating, based on the pulse period and the target control position, a control time for each cylinder at every reference piston position; and timer-operation determining means for determining at every reference piston position whether the timer means has already done control on the cylinders and for setting and resetting the timer means in the above-described manner on the basis of the result of the timer-operation determination.

According to another aspect of the present invention, there is provided an engine control method for controlling the operation of an internal combustion engine which has a plurality of cylinders and timer means for controlling the operations of the cylinders.

The method comprising the following steps of:

generating a positional signal in the form of pulses representative of a reference piston position of each cylinder in synchrony with the rotation of the engine;

sensing the operating conditions of the engine and generating an output signal representative of the sensed engine operating conditions;

calculating, based on the positional signal and the output signal of the sensor means, control times for controlling the corresponding cylinders at every reference piston position;

determining, at every reference piston position, whether the timer means has already done control on the cylinders;

resetting the timer means to new control times which are calculated at the present reference piston position for controlling the present operations of cylinders if it is determined that the timer means has yet to do control on the cylinders; and setting the timer means to new control times which are calculated at the present reference piston position for controlling the next operations of cylinders if it is determined that the timer means has already done control on the cylinders.

The above and other objects, features and advantages of the present invention will become apparent from the following detailed description of a preferred embodiment of the invention when taken in conjunction with the accompanying drawings.

DESCRIPTION OF THE PREFERRED EMBODIMENT

The present invention will now be described in detail with reference to the accompanying drawings. The present invention can be applied to the conventional engine control apparatus as shown in FIGS. 5 through 9, and to this end, it is only necessary to change the calculation and control means 12 inside the microcomputer 10 of the conventional apparatus and a portion of a conventional control program which is executed by the calculation and control means 12. Therefore, the present invention will be described below while referring to FIGS. 5 through 9 as well.

Figure 4:
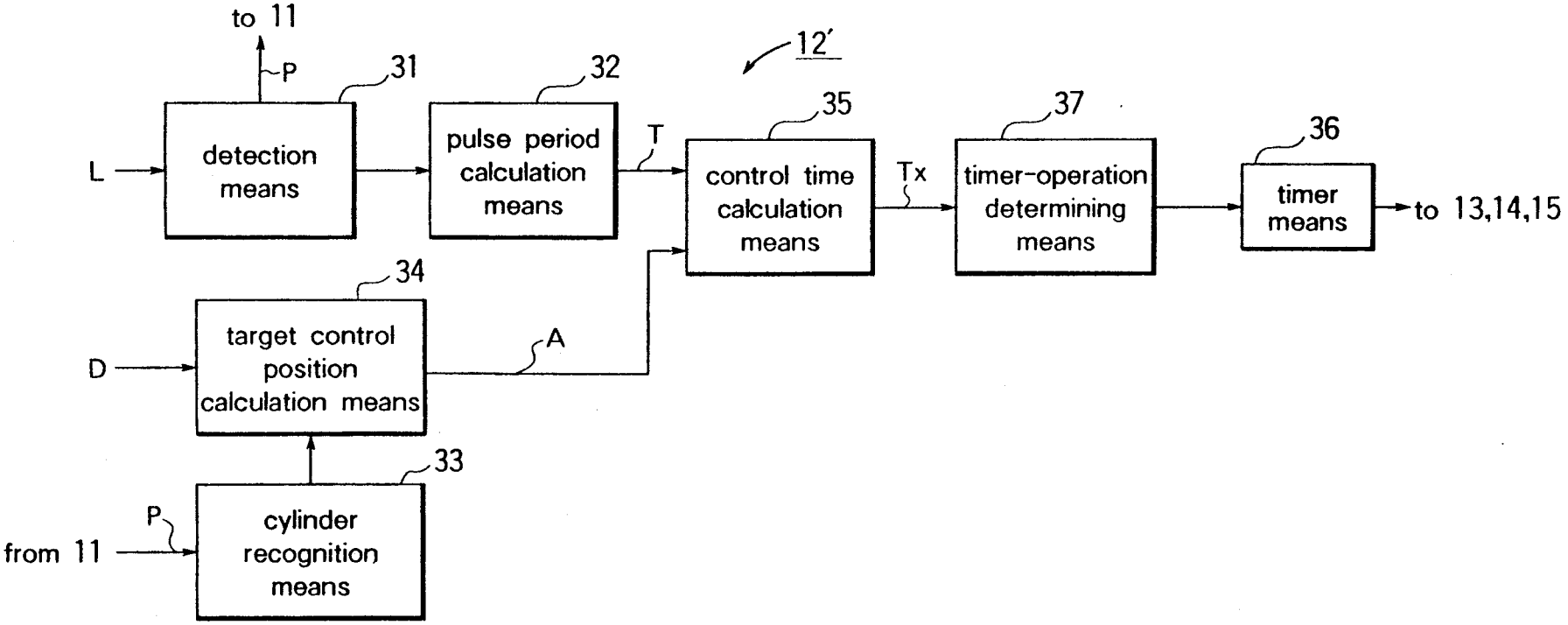
FIG. 4 is a block diagram showing the detail of a calculation and control means according to the present invention.
Figure 5:
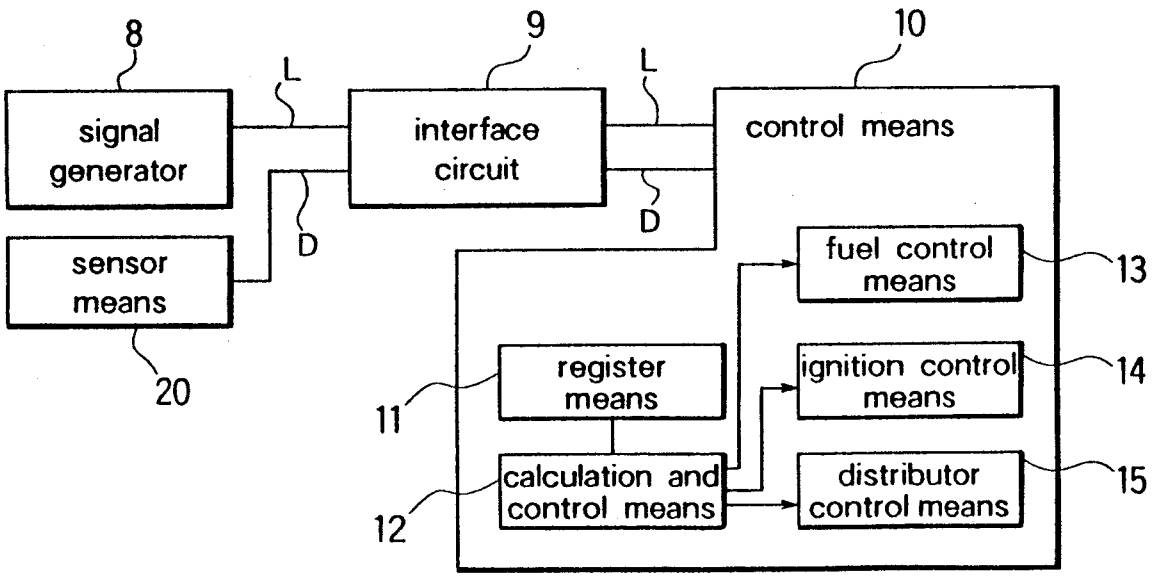
FIG. 5 is a schematic block diagram showing the general construction of a conventional engine control apparatus.
Figure 6:
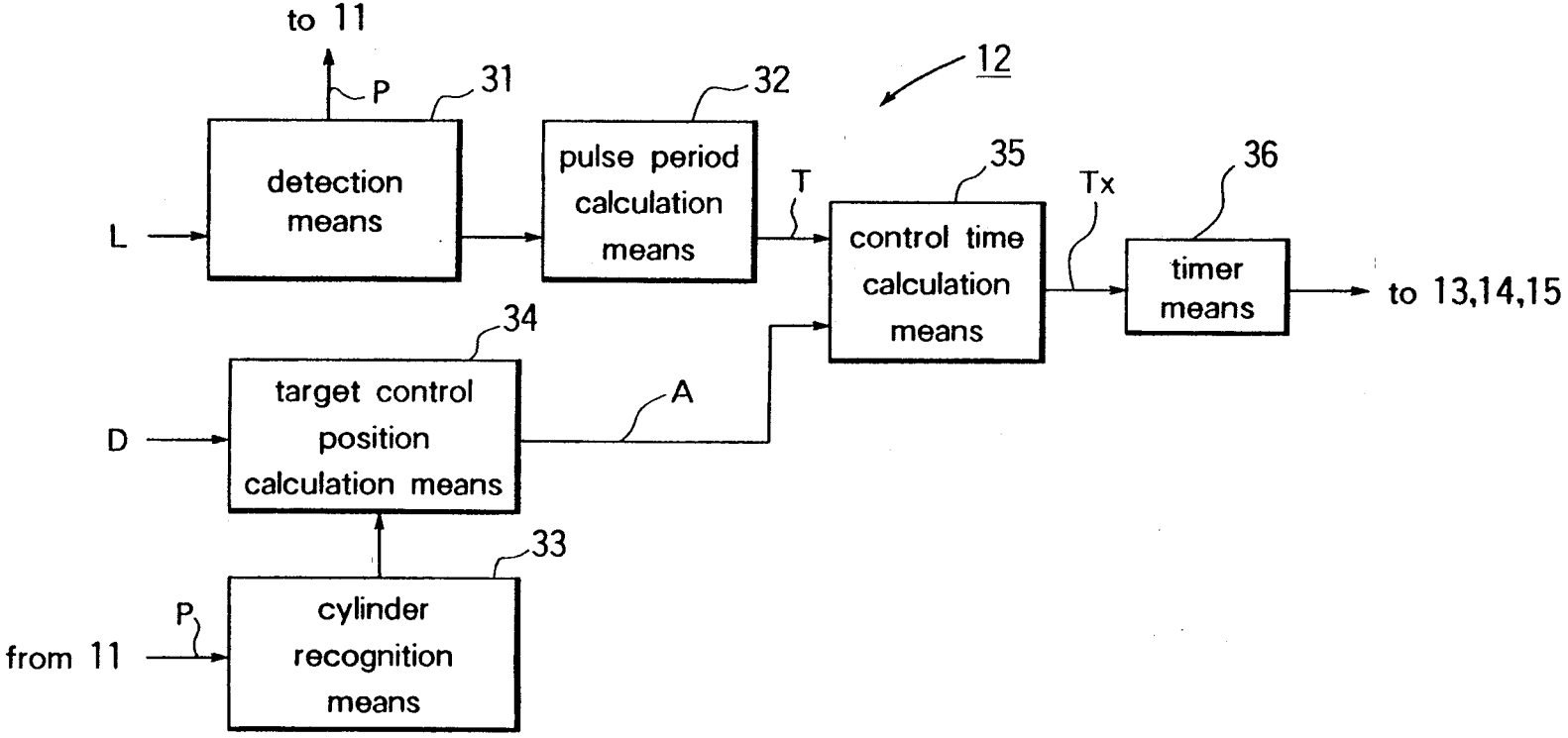
FIG. 6 is a block diagram showing the detail of a calculation and control means of FIG. 4.
Figure 7:
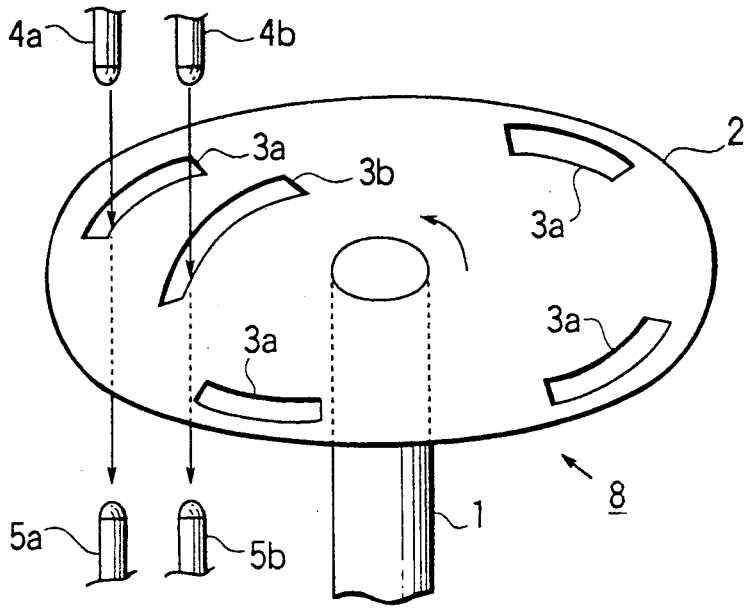
FIG. 7 is a schematic perspective view of a signal generator of FIG. 5.
Figure 8:
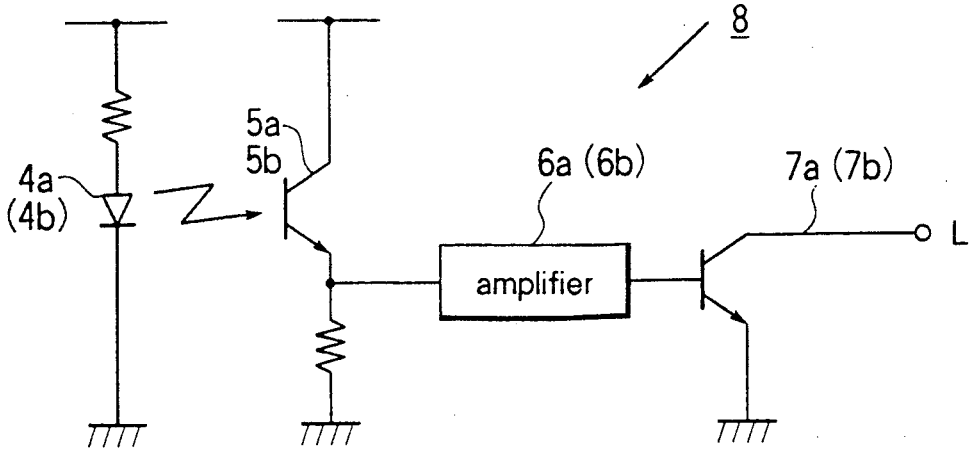
FIG. 8 is a schematic circuit diagram of an electric circuit of the signal generator.
Figure 9:
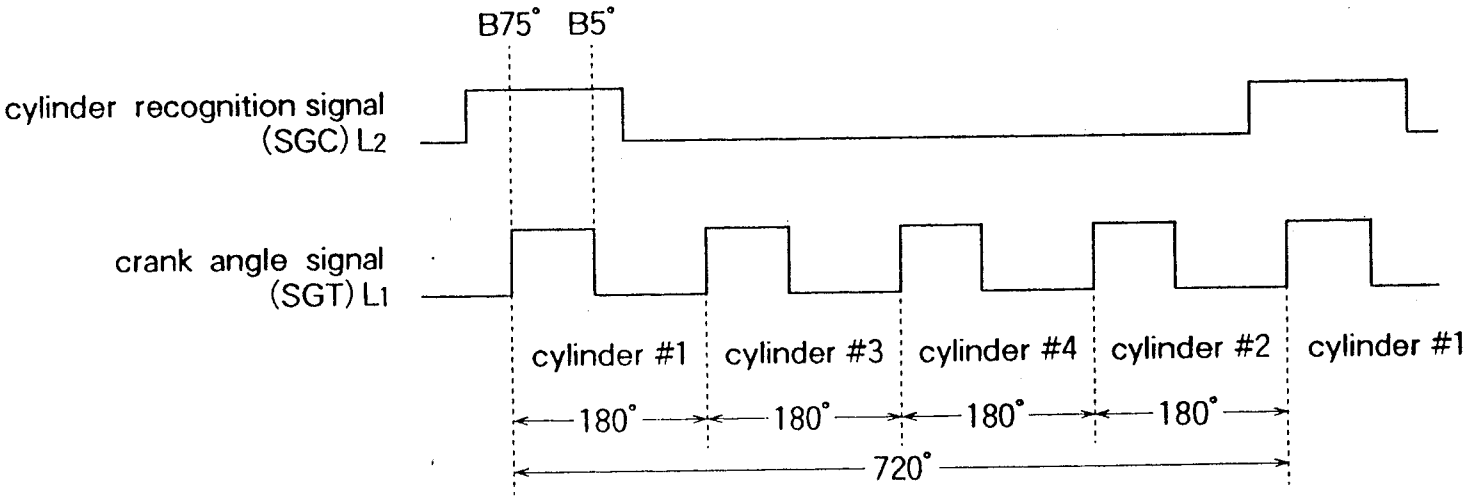
FIG. 9 is a diagrammatic view showing the waveforms of first and second positional signals SGT and SGC generated by the signal generator.

First, an engine control apparatus of the present invention comprises, though not illustrated, the same components as the elements 8 through 15 and 20 of the conventional apparatus as shown in FIG. 5. However, as shown in FIG. 4, the calculation and control means 12' of the present invention is different in construction and operation from the conventional calculation and control means 12 of FIG. 6 in that it further includes, in addition to the same components 31 through 36, a timer-operation determining means 37 for determining at every reference piston position whether the timer means 36 has already done control on the cylinders of an engine and for setting and resetting the timer means on the basis of the result of the timer-operation determination.

Figure 2:
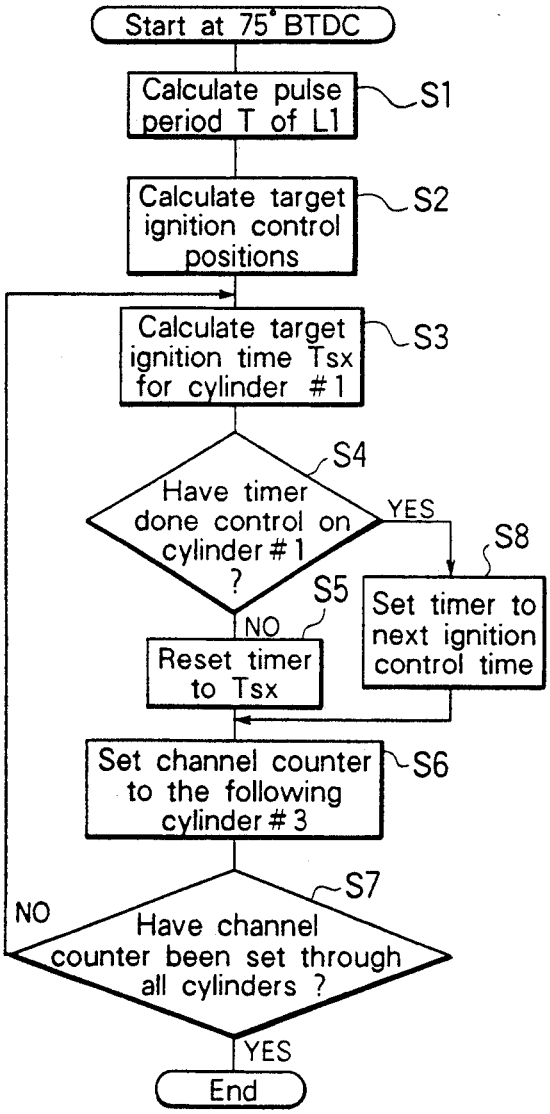
FIG. 2 is a flow chart showing a first timer setting interrupt routine which is executed at 75 degrees BTDC according to the present invention.
Figure 3:
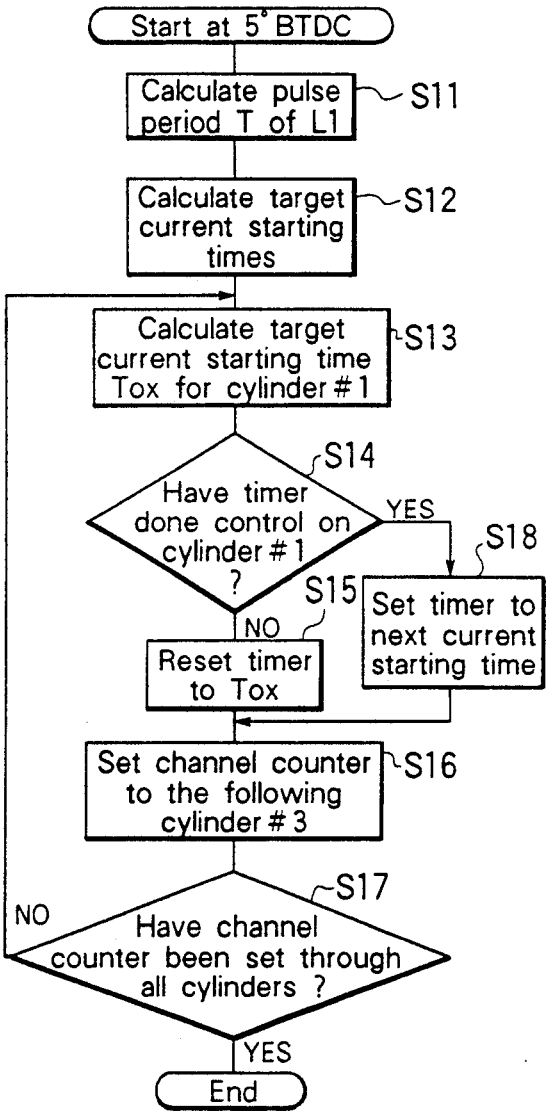
FIG. 3 is a flow chart showing a second timer setting interrupt routine which is executed at 5 degrees BTDC according to the present invention.

Specifically, the calculation and control means 12' of FIG. 4 performs cylinder recognition based on the crank angle signal (SGT) L1 and the cylinder recognition signal (SGC) L2 in the same manner as described before, and it also executes a first interrupt routine at every first reference piston position (e.g., 75 degrees BTDC), as shown in FIG. 2, and a second interrupt routine at every second reference piston position (e.g., 5 degrees BTDC), as shown in FIG. 3, so that it sets the timer means 36 to appropriate ignition times for the corresponding cylinders #1 through #4.

More specifically, according to the present invention, the microcomputer executes the first interrupt routine in the following manner. As shown in FIG. 2, first in Step S1, the pulse period calculation means 32 of the calculation and control means 12 calculates the pulse period T between two consecutive first reference piston positions (i.e., the rising edges of two consecutive square pulses of the crank angle signal L1) at every first reference piston position (e.g., 75 degrees BTDC for each cylinder). Then in Step S2, the target control position calculation means 34 calculates a target ignition position or crank angle As for each cylinder at which ignition of a cylinder should take place.

In Step S3, the control time calculation means 35 calculates, based on the pulse period T and the target ignition position As for the first cylinder #1, an appropriate target current-supply cut-off time or ignition time Ts1 for the first cylinder #1 to which a corresponding current-supply cut-off timer of the timer means 36 is set. In this connection, it is to be noted that a target ignition time Tsx (x=1 through 4) for a corresponding cylinder (#1 through #4) corresponds to a length of time after the lapse of which a corresponding current-supply cut-off timer cuts off the current supply to an ignition coil so as to cause the ignition of the corresponding cylinder.

Subsequently, in Step S4, making reference to a timer control job flag in the register means 11, the calculation and control means 12' determines whether a first current-supply cut-off timer has already cut off the current supply to a first ignition coil so as to ignite the first cylinder #1. If the answer is "NO" (i.e., there is no timer control job flag for the first timer set in the register means 11), the program goes to Step S5 where the first current-supply cut-off timer is reset to the above calculated first target ignition time Ts1 for the present ignition of the first cylinder #1. On the other hand, if the answer is "YES", the program goes to Step S8 where the first current-supply cut-off timer is set to the first target ignition time Ts1 in preparation for the next ignition of the first cylinder #1.

Thereafter, in Step S6, an unillustrated channel counter incorporated in the microcomputer 10 is set to the following cylinder #3. Then in Step S7, it is determined whether the channel counter has already been set through all the cylinders. If the answer is "NO", the program returns to Step S3 and thereafter the Steps S3 through S7 for the cylinder #3 are repeated. Similarly, the same Steps S3 through S7 are successively repeated for the cylinders #4, #2 until the answer in Step S7 becomes "YES". If the answer is "YES" in Step S7, the first interrupt routine ends.

Similarly, as shown in FIG. 3, the second interrupt routine is executed at every second reference piston position (i.e., 5 degrees BTDC) so as to set the current-supply starting timers of the timer means 36 to respective current-supply starting times. In this connection, Steps S11 through S18 of FIG. 3 correspond to Steps 1 through 8 of FIG. 2.

Specifically, first in Step S11, the pulse period calculation means 32 calculates the pulse period T between two consecutive second reference piston positions (i.e., the falling edges of two consecutive square pulses of the crank angle signal L1) at every second reference piston position (e.g., 5 degrees BTDC). Then in Step S12, the target control position calculation means 34 calculates a target current-supply starting position or crank angle Ao for each cylinder at which current supply to a corresponding ignition coil should start.

In Step S13, the control time calculation means 35 calculates, based on the pulse period T and the target current-supply starting position Ao for the first cylinder #1, an appropriate target current-supply starting time To1 for the first cylinders #1 to which a corresponding current-supply starting timer of the timer means 36 is set. In this regard, a target current-supply starting time Tox (x=1 through 4) for a corresponding cylinder (1# through #4) corresponds to length of time after the lapse of which a corresponding current-supply starting timer operates to start the current supply to a corresponding ignition coil.

Subsequently, in Step S14, making reference to a timer control job flag in the register means 11, the calculation and control means 12 determines whether a first current-supply starting timer has already operated to start the current supply to the first ignition coil. If the answer is "NO" (i.e., there is no timer control job flag for the first timer set in the register means 11), the program goes to Step S15 where the first current-supply starting timer is reset to the above calculated first target current-supply starting time To1 for the present ignition of the first cylinder. On the other hand, if the answer is "YES", the program goes to Step S18 where the first current-supply starting timer is set to the first target current-supply starting time To1 in preparation for the next ignition of the first cylinder #1.

Thereafter, in Step S16, the channel counter is set to the following cylinder #3. Then in Step S17, it is determined whether the channel counter has already set through all the cylinders. If the answer is "NO", the program returns to Step S13 and thereafter Steps S13 through S17 for the cylinder #3 are repeated. Similarly, the same Steps S13 through S17 are successively repeated for the cylinders #4, #2 until the answer in Step S17 becomes "YES". If the answer is "YES" in Step S17, the second interrupt routine ends.

Figure 1:
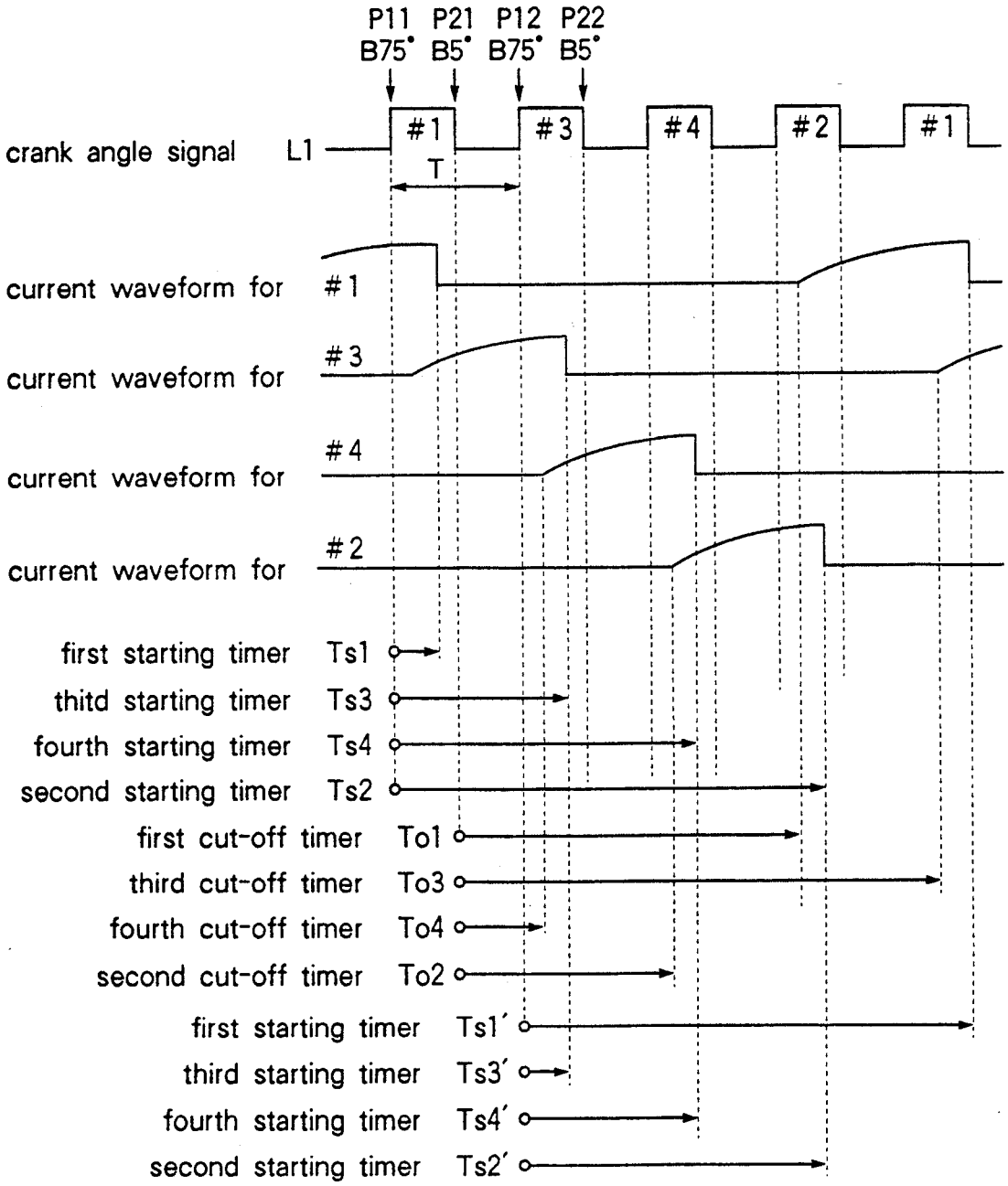
FIG. 1 is a diagrammatic view illustrating the sequence of the operations performed by the present invention.

As clearly seen from FIG. 1, at a first reference piston position P11 of 75 degrees BTDC of a cylinder (e.g., cylinder #1), the first through fourth current-supply cut-off timers are first set to the ignition times Ts1 through Ts4 for the corresponding cylinders #1 through #4, respectively, which are calculated at the first reference piston position P11, and then at the following first reference piston position P12 of 75 degrees BTDC of another cylinder (e.g., cylinder #3), they are basically reset or updated to the new ignition times Ts1' through Ts4', respectively, which are calculated at the following first reference piston position P12. In this case, however, at the following first reference piston position P12, the first current-supply cut-off timer has already operated to cut off the current supply to the first ignition coil so as cause the ignition of the first cylinder #1. Therefore, at P12, the first current-supply cut-off timer is not reset but merely set to the new ignition time Ts1' for the next ignition of the first cylinder #1. On the other hand, the other second through fourth current-supply cut-off timers, which have not yet done current-supply cut-off operations, are reset or updated to the new ignition times Ts2' through Ts4', respectively.

Similarly, as shown in FIG. 1, at a second reference piston position P21 of 5 degrees BTDC of the first cylinder #1, the first through fourth current-supply starting timers are first set to current-supply cut-off times To1 through To4 for the corresponding cylinders #1 through #4, respectively, which are calculated at the second reference piston position P21, and then at the following second reference piston position P22 of 5 degrees BTDC of the third cylinder #3, they are basically reset to new current-supply starting times To1' through To4', respectively, which are calculated at the following second reference piston position P22. In this case, however, at the following second reference piston position P22, the third current-supply starting timer has already operated to start the current supply to a third ignition coil for the present ignition of the third cylinder #3, and therefore it is set to the new current-supply starting time To3' for the next ignition of the third cylinder #3. On the other hand, the other first, second and fourth current-supply starting timers, which have not yet done current-supply starting operations, are reset or updated to the new ignition times To1', To2' and To4', respectively.

In the above manner, at every first and second reference piston position of 75 and 5 degrees BTDC, the current-supply cut-off timers and the current-supply starting timers are reset or updated to new ignition times and new current-supply starting times if they have yet to do current-supply cut-off or starting operations which were set at the preceding reference piston positions, so that ignition control on the respective cylinders can immediately follow a sudden change in the pulse period T of the crank angle signal L1 in a real-time fashion which could be caused by a sudden change in the rotational speed of the engine.

To this end, it is only required to successively update the respective independent timers each time the current-supply control or the ignition control is performed. Accordingly, in order to meet the problems such as overlap of control times, an increase in number of the control channels for the cylinders, a relatively simple control program can be employed without increasing the load such as increased operational calculations on the hardware components.

Although in the above-described embodiment, the current-supply cut-off times Tsx are set or reset at every first reference piston position of 75 degrees BTDC and the current-supply starting times Tox are set or reset at every second reference piston position of 5 degrees BTDC, it is possible to simultaneously set or reset all of these timers to the times Tsx and Tox at every first and second reference piston position if the microcomputer has ample calculation and timer-setting capacity.

Further, although in the above embodiment, two separate signals comprising a first signal in the form of a crank angle signal L1 and a second signal in the form of a cylinder recognition signal L2 are employed, a single signal can also be used which contains a series of pulses which comprise a plurality of crank angle pulses each representative of a first and a second reference piston position of a corresponding cylinder and a cylinder recognition pulse corresponding to a specific cylinder. In this case, too, substantially the same results will be provided.

Moreover, although the above description has been made of the ignition control of an engine, the present invention is also applicable to various other timer-controlled engine operations such as timer-controlled fuel injection control while providing substantially the same results.

As described in the foregoing, according to the present invention, it is determined at every reference piston position of the cylinders whether a timer-controlled operation has been done, and if such an operation has yet to occur, timers are reset or updated to new control times. Accordingly, it becomes possible to perform real-time control on various engine operations immediately following a change in the rotational speed of the engine (i.e., a change in the pulse period of the crank angle signal) by the use of a simple control program, thus substantially improving the accuracy in such engine control in an easy and simple way.

What is claimed is:

1. An engine control apparatus for controlling the operation of an internal combustion engine which has a plurality of cylinders, the apparatus comprising:

a signal generator for generating a positional signal in the form of pulses representative of a reference piston position of each cylinder in synchrony with the rotation of the engine;

sensor means for sensing the operating conditions of the engine and generating an output signal representative of the sensed engine operating conditions; and control means including a plurality of timers each controlling the operation of a corresponding cylinder, said control means being operable to calculate, based on the positional signal and the output signal of said sensor means, control times for controlling the corresponding cylinders at every reference piston position, and to determine, at every reference piston position, whether said timers have already implemented control on the corresponding cylinders, said control means further operating such that said timers are reset to new control times which are calculated at a present reference piston position for controlling the present operations of the corresponding cylinders if said timers have not yet implemented control on the corresponding cylinders, whereas said timers are set to new control times which are calculated at the present reference piston position for controlling the next operations of the corresponding cylinders if said timers have already implemented control on the corresponding cylinders.

2. An engine control apparatus as claimed in claim 1, wherein said control means comprises:

detection means for detecting each reference piston position based on the positional signal;

pulse period calculating means for calculating the pulse period of the positional signal between the preceding two successive pulses at every reference piston position;

cylinder recognition means for recognizing, based on the output of said detection means, to which cylinder a pulse of the positional signal corresponds;

target control position calculation means for calculating, based on the result of the cylinder recognition and the output signal of said sensor means, a target control position for each cylinder;

control time calculation means for calculating, based on the pulse period and the target control position, a control time for each cylinder at every reference piston position; and timer-operation determining means for determining at every reference piston position whether said timers have already implemented control on the cylinders and for setting and resetting said timer means in the above-described manner on the basis of the result of the timer-operation determination.

3. An engine control apparatus as claimed in claim 2, wherein said control means includes ignition control means which is operated by said timers for properly controlling the ignition of each cylinder.

4. An engine control apparatus as claimed in claim 1, wherein said control means comprises fuel injection control means which is operated by said timers for properly controlling the injection of fuel into each cylinder.

5. An engine control method for controlling the operation of an internal combustion engine which has a plurality of cylinders and timers for controlling the operations of the corresponding cylinders, the method comprising the following steps of:

generating a positional signal in the form of pulses representative of a reference piston position of each cylinder in synchrony with the rotation of the engine;

sensing the operating conditions of the engine and generating an output signal representative of the sensed engine operating conditions;

calculating, based on the positional signal and the output signal of said sensor means, control times for controlling the corresponding cylinders at every reference piston position;

determining, at every reference piston position, whether said timers have already implemented control on the corresponding cylinders;

resetting said timers to new control times which are calculated at a present reference piston position for controlling the present operations of the corresponding cylinders if it is determined that said timers have not yet implemented control on the corresponding cylinders; and setting said timers to new control times which are calculated at the present reference piston position for controlling the next operations of the corresponding cylinders if it is determined that said timers have already implemented control on the corresponding cylinders.

* * * * *